US010267527B2

(12) United States Patent
Aoyama et al.

(10) Patent No.: US 10,267,527 B2
(45) Date of Patent: Apr. 23, 2019

(54) OUTDOOR UNIT FOR AN AIR-CONDITIONING DEVICE

(71) Applicant: Mitsubishi Electric Corporation, Tokyo (JP)

(72) Inventors: Yutaka Aoyama, Tokyo (JP); Yudai Morikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 157 days.

(21) Appl. No.: 14/785,723

(22) PCT Filed: Jun. 4, 2014

(86) PCT No.: PCT/JP2014/064849
§ 371 (c)(1),
(2) Date: Oct. 20, 2015

(87) PCT Pub. No.: WO2014/196569
PCT Pub. Date: Dec. 11, 2014

(65) Prior Publication Data

US 2016/0131371 A1 May 12, 2016

(30) Foreign Application Priority Data

Jun. 4, 2013 (JP) ..... 2013-117516

(51) Int. Cl.
*F28F 1/10* (2006.01)
*F24F 1/16* (2011.01)
(Continued)

(52) U.S. Cl.
CPC ..... *F24F 1/16* (2013.01); *F24F 1/18* (2013.01); *F24F 1/38* (2013.01); *F24F 1/48* (2013.01);
(Continued)

(58) Field of Classification Search
CPC ..... F24F 1/16; F24F 1/56; F24F 1/50; F24F 1/32; F24F 1/48; F24F 1/38; F24F 1/18;
(Continued)

(56) References Cited

U.S. PATENT DOCUMENTS 4,307,778 A 12/1981 Tobin et al.
6,050,328 A * 4/2000 Shikazono ..... F28D 1/0477 165/121
(Continued)

FOREIGN PATENT DOCUMENTS

JP S56-160586 A 12/1981
JP 2003-279073 A 10/2003
(Continued)

OTHER PUBLICATIONS

Extended European Search Report dated Mar. 23, 2017 issued in corresponding EP patent application No. 14808456.9.
(Continued)

*Primary Examiner* — Keith Raymond
*Assistant Examiner* — Kamran Tavakoldavani
(74) *Attorney, Agent, or Firm* — Posz Law Group, PLC

(57) ABSTRACT

Provided is an outdoor unit for an air-conditioning apparatus, including a heat exchanger having heat exchanger cores stacked in a plurality of stages in a vertical direction of the outdoor unit. Each of the heat exchanger cores includes: a plurality of fins arranged in parallel to each other at intervals therebetween; and heat transfer tubes provided to extend through the fins, through which refrigerant is caused to flow. Each of the fins of the heat exchanger includes a deformable portion configured to be deformable by impacts applied to the deformable portion, which is formed at a position where the fins of the upper one of the heat exchanger cores from among the vertically-adjacent heat exchanger cores comes into contact with the fins of the lower one of the heat
(Continued)

exchanger cores from among the vertically-adjacent heat exchanger cores.

20 Claims, 6 Drawing Sheets

(51) Int. Cl.

| | |
|---|---|
| ***F24F 1/18*** | (2011.01) |
| ***F28F 1/32*** | (2006.01) |
| ***F24F 1/50*** | (2011.01) |
| ***F24F 1/38*** | (2011.01) |
| ***F24F 1/48*** | (2011.01) |
| ***F24F 1/56*** | (2011.01) |

(52) U.S. Cl.
CPC ..... *F24F 1/50* (2013.01); *F24F 1/56* (2013.01); *F28F 1/32* (2013.01); *F28F 2215/12* (2013.01)

(58) Field of Classification Search
CPC ..... F28F 1/32; F28F 2215/12; F28D 1/0417; F28D 1/0426
See application file for complete search history.

(56) References Cited

U.S. PATENT DOCUMENTS

| | | | | |
|---|---|---|---|---|
| 2002/0134099 | A1* | 9/2002 | Mochizuki | F24F 1/18 62/285 |
| 2005/0235678 | A1* | 10/2005 | Lee | F24F 12/006 62/412 |
| 2007/0062677 | A1* | 3/2007 | Usui | F28D 1/0477 165/150 |
| 2008/0041571 | A1* | 2/2008 | Minami | B23K 1/0012 165/151 |
| 2013/0081417 | A1* | 4/2013 | Tamura | F25B 13/00 62/160 |

FOREIGN PATENT DOCUMENTS

| | | | |
|---|---|---|---|
| JP | 2006-046694 | A | 2/2006 |
| JP | 2009-079851 | A | 4/2009 |
| JP | 2010-139097 | A | 6/2010 |
| JP | 2012-102992 | A | 5/2012 |

OTHER PUBLICATIONS

International Search Report of the International Searching Authority dated Sep. 9, 2014 for the corresponding international application No. PCT/JP2014/064849 (and English translation).

* cited by examiner

OUTDOOR UNIT FOR AN AIR-CONDITIONING DEVICE

CROSS-REFERENCE TO RELATED APPLICATION

This application is a U.S. national stage application of PCT/JP2014/064849 filed on Jun. 4, 2014, which claims priority to Japanese patent application No. 2013-117516 filed on Jun. 4, 2013, the contents of which are incorporated herein by reference.

TECHNICAL FIELD

The present invention relates to an outdoor unit for an air-conditioning apparatus, and more particularly, to the support structure for a heat exchanger mounted on an outdoor unit.

BACKGROUND

As an outdoor unit for an air-conditioning apparatus to be installed in buildings, commercial facilities, or other constructions, there is proposed an outdoor unit including a heat exchanger arranged on each of a rear surface and side surfaces of the outdoor unit, and a fan arranged on an upper surface of the outdoor unit (see, for example, Patent Literature 1). In the technology disclosed in Patent Literature 1, the heat exchanger mounted on the outdoor unit includes heat transfer tubes each being formed into a circular shape or a flat shape, through which refrigerant is caused to flow, and a plurality of fins each being arranged in parallel to an airflow direction, to which the heat transfer tubes are connected.

In the technology disclosed in Patent Literature 1, the fins and the heat transfer tubes arranged on the heat exchanger are fixed by, for example, brazing or bonding, and the heat transfer tubes of the heat exchanger are supported by fixing plates (first end plate and second end plate) mounted on one end portion side and the other end portion side of the heat exchanger in its horizontal direction. Thus, in the technology disclosed in Patent Literature 1, in which the heat transfer tubes of the heat exchanger are supported by the fixing plates, even when vibrations are applied to the heat exchanger during its transportation or drop impacts are applied to the heat exchanger, the impacts are dispersed into the heat transfer tubes via the fixing plates, thereby suppressing concentration of the impacts on the fins. As a result, deformation of the fins can be suppressed.

If the fixing plates are not provided, however, for example, the lowermost end side of the fins of the heat exchanger may be deformed. That is, the weight of the heat exchanger is borne by the lowermost end side of the fins, and hence the deformation is liable to occur due to vibrations applied to the heat exchanger during its transportation or drop impacts applied to the heat exchanger. The deformation of the lowermost end side of the fins may cause degradation in drainage or trouble with design of the heat exchanger. When the drainage is degraded, remaining water is frozen during the operation and the ice is grown, which may cause damage to the heat transfer tubes.

PATENT LITERATURE

Patent Literature 1: Japanese Unexamined Patent Application Publication No. 2009-79851 (see, for example, FIG. 1 and FIG. 2)

In the technology disclosed in Patent Literature 1, the fixing plates are provided to suppress the deformation of the heat exchanger due to vibrations applied to the heat exchanger during its transportation or drop impacts applied to the heat exchanger. However, there is a problem of increase in manufacturing cost by an amount corresponding to the fixing plates provided to the heat exchanger.

When a heat exchanger including heat transfer tubes each having a circular shape is manufactured as in the technology disclosed in Patent Literature 1, the fixing plates are processed by punching or other methods, and the heat transfer tubes are inserted through the portions thus punched out, thereby being capable of obtaining a heat exchanger including the fixing plates for supporting the heat transfer tubes. When a heat exchanger including heat transfer tubes each having a flat shape is manufactured, however, the shape of each fixing plate is complicated due to the flat shape so that the fixing plate is difficult to manufacture. As a result, there is a problem of increase in manufacturing cost.

Further, when a heat exchanger including heat transfer tubes each having a flat shape is manufactured, a method using a pipe-expanding ball, which is generally used for heat transfer tubes each having a circular shape, cannot be used for bringing the heat transfer tubes and the fins into close contact with each other. That is, in the case of a heat exchanger including heat transfer tubes each having a flat shape, cutouts for inserting the heat transfer tubes each having a flat shape are formed in the fins, and the heat transfer tubes are inserted through the cutouts to secure the close contact between the heat transfer tubes and the fins.

As described above, when a heat exchanger including heat transfer tubes each having a flat shape is manufactured, the heat transfer tubes and the fixing plates cannot be fixed to each other unless the fixing plates are welded or bonded similarly to the fins. Thus, in the case of heat transfer tubes each having a flat shape, the number of processing steps or working steps are increased as compared to the case of heat transfer tubes each having a circular shape. As a result, there is a problem of increase in manufacturing cost.

SUMMARY

The present invention has been made to solve the problem as described above, and it is therefore an object of the present invention to provide an outdoor unit for an air-conditioning apparatus, which is constructed such that deformation of a lowermost end side of fins of a heat exchanger is suppressed while reducing manufacturing cost.

According to one embodiment of the present invention, there is provided an outdoor unit for an air-conditioning apparatus, including a heat exchanger having heat exchanger cores stacked in a plurality of stages in a vertical direction of the outdoor unit, each of the heat exchanger cores including: a plurality of fins arranged in parallel to each other at intervals therebetween; and heat transfer tubes provided to extend through the plurality of fins, each of the heat transfer tubes allowing refrigerant to flow therethrough, each of the plurality of fins of the heat exchanger including a deformable portion configured to be deformable by impacts applied to the deformable portion, the deformable portion being formed at a position where the plurality of fins of the upper one of the heat exchanger cores from among the heat exchanger cores adjacent to each other in the vertical direction of the outdoor unit and the plurality of fins of the lower one of the heat exchanger cores from among the heat exchanger cores adjacent to each other in the vertical direction of the outdoor unit are brought into abutment against each other.

According to the outdoor unit for an air-conditioning apparatus of the one embodiment of the present invention, the manufacturing cost can be suppressed by an amount corresponding to the omission of the fixing plates.

Further, with the above-mentioned structure of the outdoor unit for an air-conditioning apparatus of the one embodiment of the present invention, even when the heat exchanger is dropped during, for example, transportation of the heat exchanger so that impacts are applied to the lowermost end side of the fins of the heat exchanger, the one end side of the fins of the upper one of the heat exchanger cores from among the vertically-adjacent heat exchanger cores, which is brought into abutment against the lower one of the heat exchanger cores, is deformed by being subjected to the drop impacts. Thus, it is possible to suppress the situation where the impacts caused by the drop of the heat exchanger or the like are concentrated on the lowermost end side of the fins of the heat exchanger (lower end side of the fins of the lowermost heat exchanger core) to cause significant deformation of this part.

DETAILED DESCRIPTION

Now, embodiments of the present invention are described with reference to the drawings.

Embodiment 1

Figure 1:
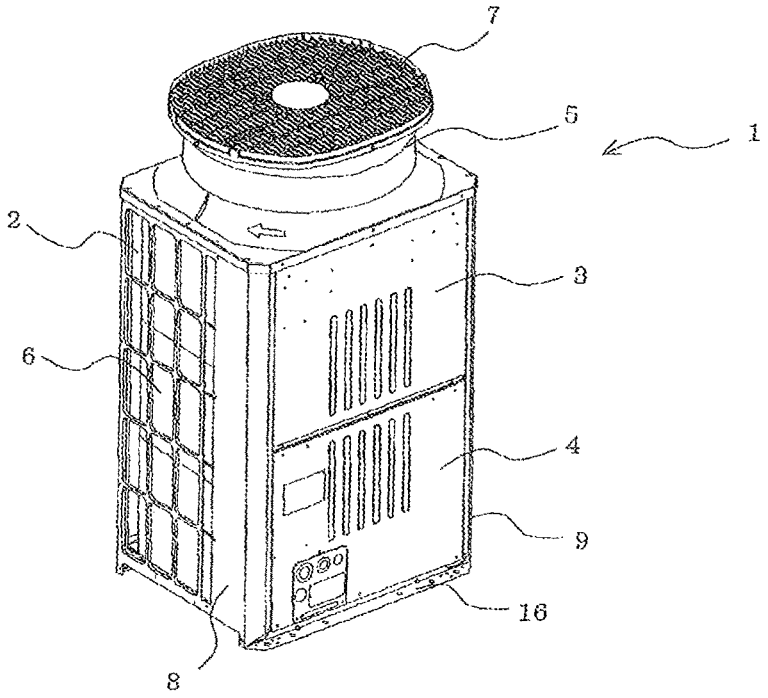
FIG. 1 is a perspective view of an outdoor unit for an air-conditioning apparatus according to Embodiment 1 of the present invention.
Figure 2:
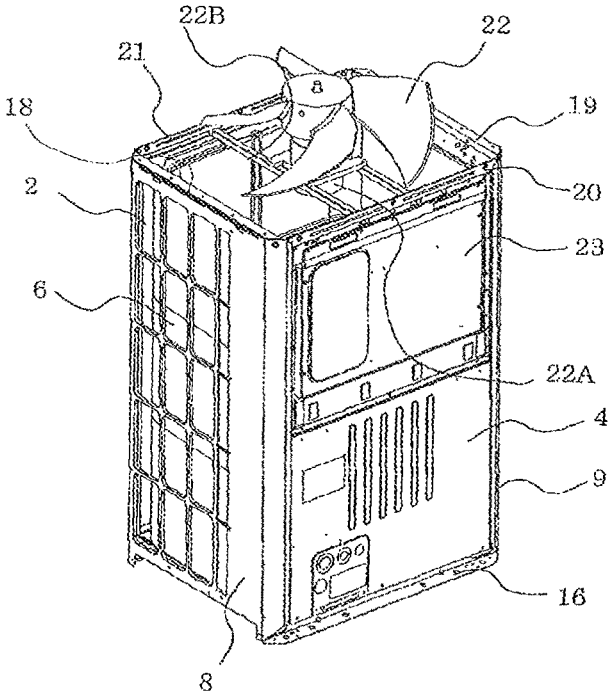
FIG. 2 is a perspective view of a state in which an upper front panel and a fan guard are removed from the outdoor unit illustrated in FIG. 1.
Figure 3:
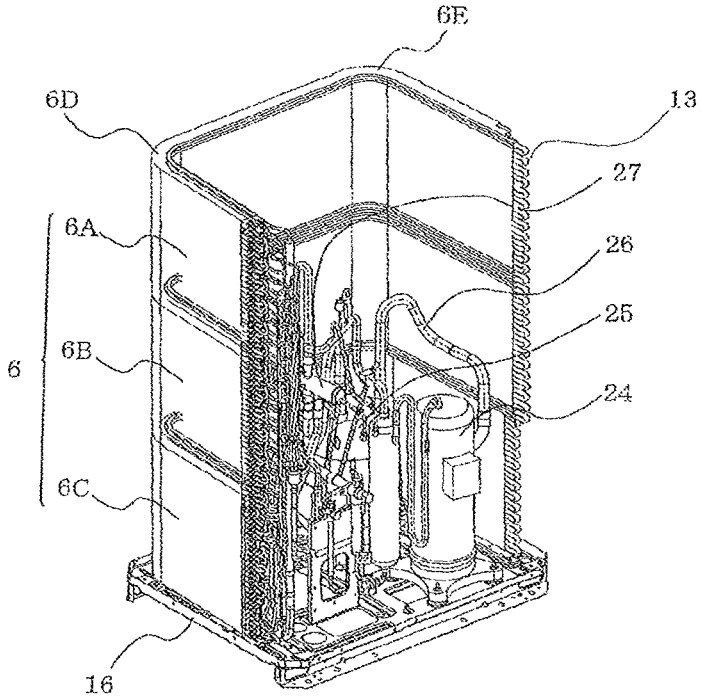
FIG. 3 is a perspective view of a state in which a right side panel, a left side panel, and other components are removed from the outdoor unit illustrated in FIG. 2.

FIG. 1 is a perspective view of an outdoor unit 1 for an air-conditioning apparatus according to Embodiment 1. FIG. 2 is a perspective view of a state in which an upper front panel 3 and a fan guard 5 are removed from the outdoor unit 1 illustrated in FIG. 1. FIG. 3 is a perspective view of a state in which a left side panel 8, a right side panel 9, and other components are removed from the outdoor unit 1 illustrated in FIG. 2. This embodiment is described with reference to the drawings.

The outdoor unit 1 for an air-conditioning apparatus according to this embodiment is improved such that deformation of a lowermost end side of fins 11 of a heat exchanger 6 can be suppressed while reducing manufacturing cost.

[Description of Structure of Outdoor Unit 1]

The outdoor unit 1 is connected to an indoor unit (not shown) or other devices through refrigerant pipes to function as a heat source unit. As illustrated in FIG. 1, the outdoor unit 1 includes the upper front panel 3 and a lower front panel 4 defining an outer shell of a front side of the outdoor unit 1, the fan guard 5 arranged on an upper part of the outdoor unit 1, the left side panel 8 and the right side panel 9 defining an outer shell of side surfaces of the outdoor unit 1, and a base panel 16 defining an outer shell of a lower side of the outdoor unit 1.

The outdoor unit 1 includes a left side frame 18, a right side frame 19, a front frame 20, and a rear frame 21 for supporting a fan 22, the fan guard 5, and other components. Note that, in FIG. 1, the left side frame 18, the right side frame 19, the front frame 20, and the rear frame 21 are kept invisible due to the fan guard 5. The outdoor unit 1 has air inlets 2 formed in the side and rear surfaces of the outer shell, for taking air into the outdoor unit 1, and also has an air outlet 7 formed in the upper part of the outdoor unit 1, for exhausting air to the outside. That is, the outdoor unit 1 has the air inlets 2 formed in the left side panel 8 and the right side panel 9 and used for taking air into the outdoor unit 1, and also has the air outlet 7 formed in the fan guard 5 and used for releasing air in the inside of the outdoor unit 1 to the outside of the outdoor unit 1.

Note that, the outdoor unit 1 includes the heat exchanger 6 including heat transfer tubes 10 (see FIG. 4) each having a circular shape or a flat shape, through which refrigerant is caused to flow, and a plurality of the fins 11 (see FIG. 4) each being arranged in parallel to an airflow direction, to which the heat transfer tubes 10 are connected. The heat exchanger 6 is arranged at a position opposed to each of the left side frame 18 and the right side frame 19. In FIG. 1, a part of the heat exchanger 6 is visible through the air inlet 2.

As illustrated in FIG. 2, the outdoor unit 1 includes the fan 22 to be used for taking air into the outdoor unit 1 and exhausting air out of the outdoor unit 1. Further, as illustrated in FIG. 2, the outdoor unit 1 includes an electrical component box 23 to be exposed when the upper front panel 3 is removed, for controlling, for example, a flow of refrigerant circulating between the outdoor unit 1 and the indoor unit (not shown). Still further, the outdoor unit 1 includes a compressor 24 for compressing refrigerant and discharging the compressed refrigerant, an accumulator 25 capable of accumulating surplus refrigerant, and a four-way valve 27 to be used for switching passages of refrigerant.

(Outer Shell)

The upper front panel 3 is a member having a substantially flat-plate shape to define an outer shell of an upper front side of the outdoor unit 1. The upper front panel 3 is mounted at a position opposed to the electrical component box 23. The lower front panel 4 is a member having a substantially flat-plate shape to define an outer shell of a lower front side of the outdoor unit 1. The fan guard 5 defines an outer shell of an upper side of the outdoor unit 1, and the air outlet 7 is formed in the fan guard 5. The fan guard 5 is arranged on the upper part of the outdoor unit 1 to cover the fan 22.

The left side panel 8 is a C-shaped member formed on the outer shell of the left side surface of the outdoor unit 1. The air inlet 2 formed by a plurality of opening ports is formed in the left side panel 8.

The right side panel 9 is a C-shaped member formed on the outer shell of the right side surface of the outdoor unit 1. Although the illustration of the right side panel 9 is omitted from FIG. 1 and FIG. 2, the air inlet 2 formed by a plurality of opening ports is formed in the right side panel 9 similarly to the left side panel 8.

The base panel 16 supports the heat exchanger 6, the compressor (not shown), and other components. The base panel 16 defines the outer shell of the bottom side of the outdoor unit 1. The left side panel 8 and the right side panel 9 are fixed to the base panel 16 by, for example, screw fastening.

The left side frame 18 is fixed to an upper end side of the left side panel 8.

The right side frame 19 is fixed to an upper end side of the right side panel 9.

The front frame 20 is fixed to the left side panel 8 on a left end portion side of the front frame 20, and is fixed to the right side panel 9 on a right end portion side of the front frame 20. Further, one end side of a motor support 22B that supports a motor 22A for rotating the fan 22 is fixed to the front frame 20.

The rear frame 21 is fixed to the upper end side of the left side panel 8. Further, the other end side of the motor support 22B that supports the motor 22A for rotating the fan 22 is fixed to the rear frame 21.

(Heat Exchanger 6)

The heat exchanger 6 is configured to exchange heat between refrigerant supplied to the heat exchanger 6 and air flowing through the heat exchanger 6. Further, during a cooling operation, the heat exchanger 6 functions as a condensor (radiator) to condense and liquefy the refrigerant, whereas during a heating operation, the heat exchanger 6 functions as an evaporator to evaporate and gasify the refrigerant. The heat exchanger 6 is arranged at a position opposed to each of the left side panel 8 and the right side panel 9. For example, the heat exchanger 6 is mounted on the outdoor unit 1 under a state of being fixed to the left side panel 8, the right side panel 9, and other components.

The heat exchanger 6 includes an upper-stage heat exchanger 6A as an uppermost heat exchanger, a middle-stage heat exchanger 6B as a heat exchanger arranged at a center in a vertical direction, and a lower-stage heat exchanger 6C as a lowermost heat exchanger. The upper-stage heat exchanger 6A, the middle-stage heat exchanger 6B, and the lower-stage heat exchanger 6C are stacked in the vertical direction. Further, as illustrated in FIG. 3, each of the upper-stage heat exchanger 6A, the middle-stage heat exchanger 6B, and the lower-stage heat exchanger 6C is constructed by stacking a plurality of rows of heat exchanger cores 12 each including the heat transfer tubes 10 each having a circular shape or a flat shape, through which refrigerant is caused to flow, and the plurality of fins 11 arranged in parallel to each other at preset intervals, to which the heat transfer tubes 10 are inserted (see FIG. 5). The upper-stage heat exchanger 6A, the middle-stage heat exchanger 6B, and the lower-stage heat exchanger 6C each have a C-shape in horizontal sectional view. That is, the upper-stage heat exchanger 6A, the middle-stage heat exchanger 6B, and the lower-stage heat exchanger 6C each have a first bending portion 6D and a second bending portion 6E formed by bending each of the upper-stage heat exchanger 6A, the middle-stage heat exchanger 6B, and the lower-stage heat exchanger 6C by a substantially right angle.

Note that, Embodiment 1 is described by taking as an example a case where the vertical sectional shape of the heat transfer tube 10 is a flat shape. The heat transfer tube 10 is a flat tube inserted into the fin 11 so that the width direction of the fin 11 corresponds to a major axis of the heat transfer tube 10. Note that, the width direction of the fin 11 refers to a direction orthogonal to a vertical direction of the fin 11 and a thickness direction of the fin 11 under a state in which the heat exchanger 6 is mounted on the outdoor unit 1. The heat transfer tube 10 is made of, for example, aluminum or aluminum alloy. In the heat exchanger core 12, the heat transfer tube 10 is inserted on one end side of the fin 11 in its width direction.

(Fan 22)

The fan 22 is exposed when the fan guard 5 is removed, and is configured to take air into the outdoor unit 1 and exhaust air out of the outdoor unit 1 through the rotation of the fan 22. As described above, the fan 22 is provided so as to be surrounded by the fan guard 5, and the air outlet 7 is formed on the upper side of the fan 22. That is, the air flowing through the heat exchanger 6 arranged along the air inlets 2 is sucked into the outdoor unit 1, and is exhausted from the air outlet 7 formed in the upper part of the inside of the outer shell through the fan 22.

(Electrical Component Box 23)

The electrical component box 23 includes a controller for controlling, for example, the flow of refrigerant circulating between the outdoor unit 1 and the indoor unit (not shown), the rotation speed of the fan 22, and the frequency of the compressor 24. The electrical component box 23 is arranged at a position opposed to the upper front panel 3, and is exposed when the upper front panel 3 is removed.

(Compressor 24)

The compressor 24 is installed on, for example, the base panel 16, and is configured to compress and discharge refrigerant. The suction side of the compressor 24 is connected to the accumulator 25. Further, the discharge side of the compressor 24 is connected to the heat exchanger 6 during the cooling operation, and is connected to a use-side heat exchanger mounted on an indoor unit (not shown) during the heating operation.

(Accumulator 25)

The accumulator 25 is connected to the suction side of the compressor 24, and is configured to accumulate liquid refrigerant. The heat exchanger 6 is arranged upright on a rear side, a right side, and a left side of the accumulator 25. Further, the accumulator 25 is connected to the suction side of the compressor 24 through a refrigerant pipe 26. Note that, the refrigerant pipe 26 is a pipe extending upward from an upper part of the accumulator 25 and then extending downward to be connected to a side surface of the compressor 24, which is the suction side of the compressor 24.

(Four-Way Valve 27)

The four-way valve 27 is used for switching the passages of refrigerant. During the heating operation, the four-way valve 27 connects the discharge side of the compressor 24 and the use-side heat exchanger of the indoor unit (not shown), and also connects the suction side of the compressor 24 and the heat exchanger 6. Further, during the cooling operation, the four-way valve 27 connects the discharge side of the compressor 24 and the heat exchanger 6, and also connects the suction side of the compressor 24 and the use-side heat exchanger of the indoor unit (not shown).

[Detailed Description of Heat Exchanger 6]

Figure 4:
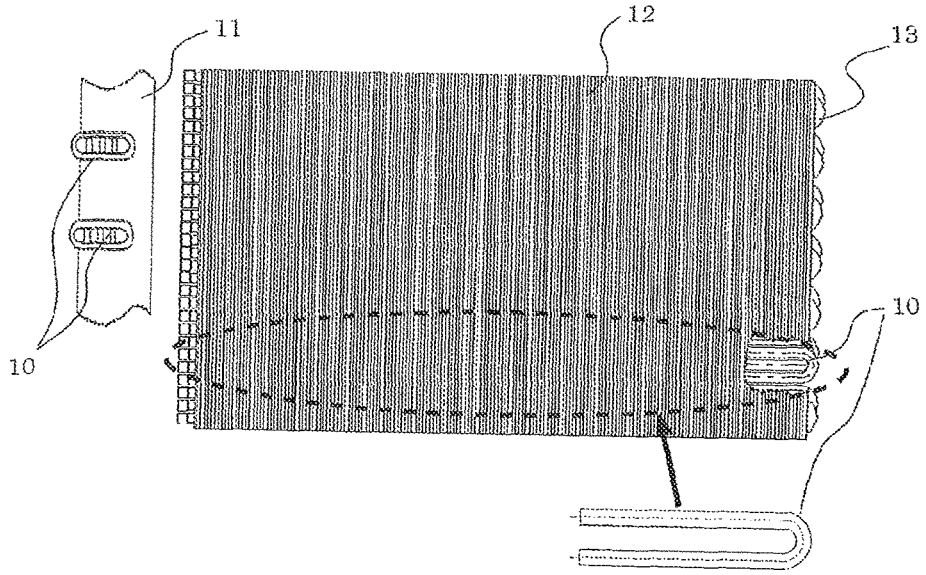
FIG. 4 is an explanatory view of a heat exchanger core of the outdoor unit for an air-conditioning apparatus according to Embodiment 1 of the present invention.
Figure 5:
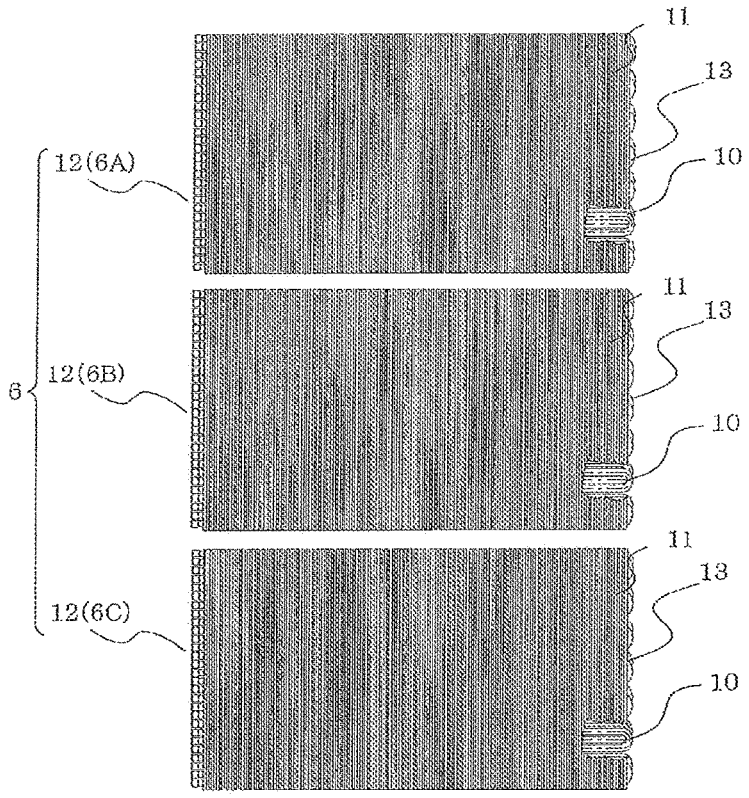
FIG. 5 is an explanatory view of how the heat exchanger cores illustrated in FIG. 4 are stacked to construct a heat exchanger.
Figure 6:
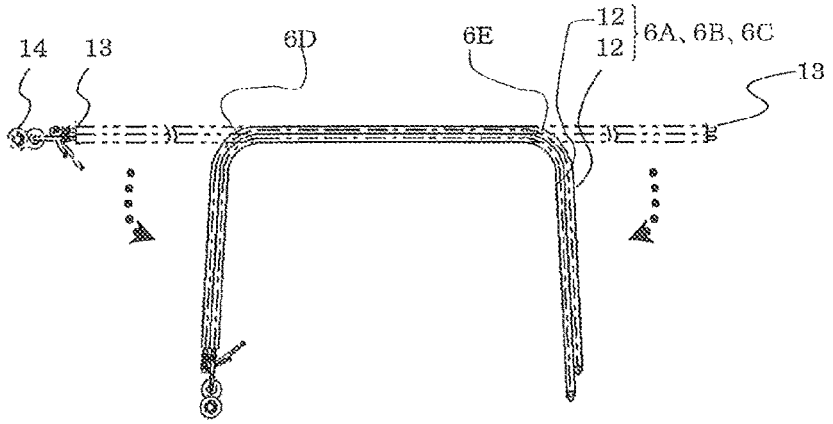
FIG. 6 is an explanatory view of how the heat exchanger is bent after U-bends and a header of the heat exchanger are brazed.

FIG. 4 is an explanatory view of the heat exchanger core 12 of the outdoor unit 1 for an air-conditioning apparatus according to Embodiment 1. FIG. 5 is an explanatory view of how the heat exchanger cores 12 illustrated in FIG. 4 are stacked to construct the heat exchanger 6. FIG. 6 is an explanatory view of how the heat exchanger 6 is bent after U-bends 13 and a header 14 of the heat exchanger 6 are brazed. Referring to FIG. 4 to FIG. 6, an example of a method of manufacturing the heat exchanger 6 is described.

A metal plate material is press-formed with a die having a preset shape to manufacture the fin 11 having cutouts to be used for inserting the heat transfer tubes 10. A plurality of the fins 11 thus manufactured by press forming are arranged in parallel to each other at preset intervals. Then, the heat transfer tubes 10 are inserted into the plurality of fins 11 thus arranged to manufacture the heat exchanger core 12. In this case, fixing plates or other members for supporting the heat transfer tubes 10 are not provided on one end portion side and the other end portion side of the heat exchanger core 12 in its horizontal direction.

A plurality of rows of the heat exchanger cores 12 are stacked to manufacture each of the upper-stage heat exchanger 6A, the middle-stage heat exchanger 6B, and the lower-stage heat exchanger 6C. The description is herein directed to, for example, a case where two rows of the heat exchanger cores 12 are stacked to manufacture each of the upper-stage heat exchanger 6A, the middle-stage heat exchanger 6B, and the lower-stage heat exchanger 6C. That is, in this example, two rows of the heat exchanger cores 12 are stacked in three stages, and hence the heat exchanger 6 is constructed by a total of six heat exchanger cores 12.

As illustrated in FIG. 5, the upper-stage heat exchanger 6A, the middle-stage heat exchanger 6B, and the lower-stage heat exchanger 6C are stacked. At this time, the upper-stage heat exchanger 6A is stacked on the middle-stage heat exchanger 6B so that the lower end side of the fin 11 of the heat exchanger core 12 of the upper-stage heat exchanger 6A and the upper end side of the fin 11 of the heat exchanger core 12 of the middle-stage heat exchanger 6B are brought into abutment against each other. Further, the middle-stage heat exchanger 6B is stacked on the lower-stage heat exchanger 6C so that the lower end side of the fin 11 of the heat exchanger core 12 of the middle-stage heat exchanger 6B and the upper end side of the fin 11 of the heat exchanger core 12 of the lower-stage heat exchanger 6C are brought into abutment against each other.

Next, as illustrated in FIG. 6, the U-bends 13 and the header 14 are brazed to the heat transfer tubes 10 of each of the upper-stage heat exchanger 6A, the middle-stage heat exchanger 6B, and the lower-stage heat exchanger 6C, and the resultant heat transfer tubes 10 are connected to a refrigerant circuit so that refrigerant is supplied to the heat exchanger 6. Then, the upper-stage heat exchanger 6A, the middle-stage heat exchanger 6B, and the lower-stage heat exchanger 6C are bent through use of a bending machine (not shown) to manufacture the heat exchanger 6 having a C-shape in horizontal cross section.

Figure 7:
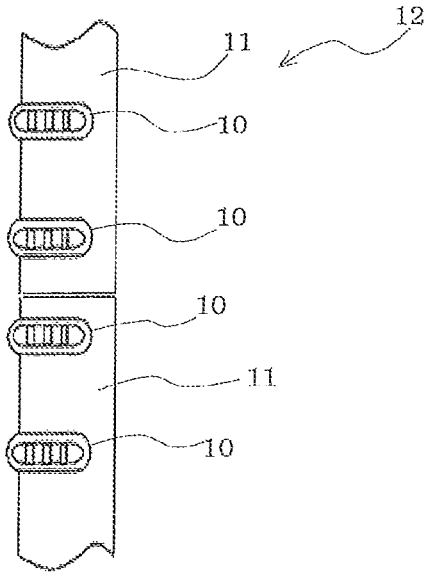
FIG. 7 is an explanatory view of the vertically-adjacent heat exchanger cores of the outdoor unit for an air-conditioning apparatus according to Embodiment 1 of the present invention.

FIG. 7 is an explanatory view of the vertically-adjacent heat exchanger cores 12 of the outdoor unit 1 for an air-conditioning apparatus according to Embodiment 1. Referring to FIG. 7, the structure of the heat exchanger 6 obtained by the manufacturing method in the above-mentioned example is described.

As illustrated in FIG. 7, the lower end side of the fin 11 of the upper one of the heat exchanger cores 12 from among the vertically-adjacent heat exchanger cores 12, which being one end side of the fin 11 in its width direction, is brought into abutment against the upper end side of the fin 11 of the lower one of the heat exchanger cores 12 from among the vertically-adjacent heat exchanger cores 12.

That is, the lower end side of the fin 11 of the heat exchanger core 12 of the upper-stage heat exchanger 6A and the upper end side of the fin 11 of the heat exchanger core 12 of the middle-stage heat exchanger 6B are brought into abutment against each other. Further, fixing plates or other members for supporting the heat transfer tubes 10 of the upper-stage heat exchanger 6A and the heat transfer tubes 10 of the middle-stage heat exchanger 6B are not provided to the upper-stage heat exchanger 6A and the middle-stage heat exchanger 6B. Note that, the lower end side of the fin 11 of the heat exchanger core 12 of the upper-stage heat exchanger 6A and the upper end side of the fin 11 of the heat exchanger core 12 of the middle-stage heat exchanger 6B are parallel to the width direction of the fin 11.

In addition, the lower end side of the fin 11 of the heat exchanger core 12 of the middle-stage heat exchanger 6B and the upper end side of the fin 11 of the heat exchanger core 12 of the lower-stage heat exchanger 6C are brought into abutment against each other. Further, fixing plates or other members for supporting the heat transfer tubes 10 of the middle-stage heat exchanger 6B and the heat transfer tubes 10 of the lower-stage heat exchanger 6C are not provided to the middle-stage heat exchanger 6B and the lower-stage heat exchanger 6C. Note that, the lower end side of the fin 11 of the heat exchanger core 12 of the middle-stage heat exchanger 6B and the upper end side of the fin 11 of the heat exchanger core 12 of the lower-stage heat exchanger 6C are parallel to the width direction of the fin 11.

[Effects of Outdoor Unit 1 for Air-Conditioning Device according to Embodiment 1]

The manufacturing cost can be suppressed by an amount corresponding to the omission of the fixing plates from the heat exchanger 6 of the outdoor unit 1 for an air-conditioning apparatus according to Embodiment 1.

In the outdoor unit 1 for an air-conditioning apparatus according to Embodiment 1, the heat exchanger cores 12 are stacked under a state in which the vertically-adjacent fins 11 are brought into abutment against each other. Therefore, even when the heat exchanger 6 is dropped during, for example, transportation of the heat exchanger 6 so that impacts are applied to the lower end side of the fin 11 of the lower-stage heat exchanger 6C, the lower end side of the fin 11 of the upper-stage heat exchanger 6A and the lower end side of the fin 11 of the middle-stage heat exchanger 6B are deformed (buckled) to disperse the impacts generated on the lower end side of the fin 11 of the lower-stage heat exchanger 6C. That is, it is possible to suppress a situation where the impacts generated when the heat exchanger 6 is dropped are concentrated on the lower end side of the fin 11 of the lower-stage heat exchanger 6C to cause significant deformation of this part. Thus, degradation in drainage of the outdoor unit 1 is suppressed, thereby suppressing damage to the heat transfer tubes 10, which may be caused by freezing of remaining water. Further, degradation in designability of the heat exchanger 6 is suppressed.

The outdoor unit 1 for an air-conditioning apparatus according to Embodiment 1 includes the heat exchanger 6 including the upper-stage heat exchanger 6A, the middle-stage heat exchanger 6B, and the lower-stage heat exchanger 6C, and the number of stages is three. It is appropriate to set the number of stages based on, for example, buckling strength ($N/mm^2$) of the fin 11, a total weight W (kg) of the fins 11 and the heat transfer tubes 10 of the heat exchanger 6, and an impact load supposed to be applied to the heat exchanger 6. Note that, when the number of stages is set to two or three, it is possible to more securely suppress, in consideration of the total weight of the heat exchanger 6, the situation where the impacts generated when the heat exchanger 6 is dropped are concentrated on the lower end side of the fin 11 of the lower-stage heat exchanger 6C to cause significant deformation of this part.

When the heat transfer tube 10 of the heat exchanger 6 is made of aluminum, aluminum alloy, or other materials, the following trouble may be caused by providing the fixing plates. Each fixing plate may be made of, for example, iron, but when the metals forming the heat transfer tube 10 and the fixing plate are different from each other, galvanic corrosion may occur. Therefore, the fixing plate needs to be manufactured of aluminum, aluminum alloy, or other materials, thereby causing such trouble that the manufacturing cost increases. Further, when the fixing plate is made of aluminum or aluminum alloy, there is caused such trouble that the fixing plate needs to be installed while being electrically isolated from the base panel 16, on which the heat exchanger 6 is to be installed, so as to suppress galvanic corrosion between the fixing plate and the base panel 16.

In the outdoor unit 1 for an air-conditioning apparatus according to Embodiment 1, the fixing plate is not provided, thereby being capable of avoiding the above-mentioned trouble.

Embodiment 1 is described on the premise that the heat exchanger 6 is constructed by stacking the respective heat exchangers 6A, 6B, and 6C in three stages in the vertical direction, but the present invention is not limited thereto. That is, similar effects may be attained when the respective heat exchangers 6A, 6B, and 6C are stacked in, for example, two or more stages in the vertical direction.

Further, Embodiment 1 is described by taking as an example the case where each of the upper-stage heat exchanger 6A, the middle-stage heat exchanger 6B, and the lower-stage heat exchanger 6C is constructed by stacking the plurality of heat exchanger cores 12, but the present invention is not limited thereto. Similar effects may also be attained in an embodiment in which each of the upper-stage heat exchanger 6A, the middle-stage heat exchanger 6B, and the lower-stage heat exchanger 6C is constructed by a single heat exchanger core 12 without stacking the heat exchanger cores 12.

Besides, Embodiment 1 is described on the premise that the heat exchanger 6 has the first bending portion 6D and the second bending portion 6E to define a C-shape in horizontal cross section, but the present invention is not limited thereto. The heat exchanger 6 may have one of the first bending portion 6D and the second bending portion 6E to define an L-shape in horizontal cross section, or may have none of the first bending portion 6D and the second bending portion 6E to define a flat-plate shape in horizontal cross section. In any case, similar effects may be attained.

Embodiment 2

Figure 8:
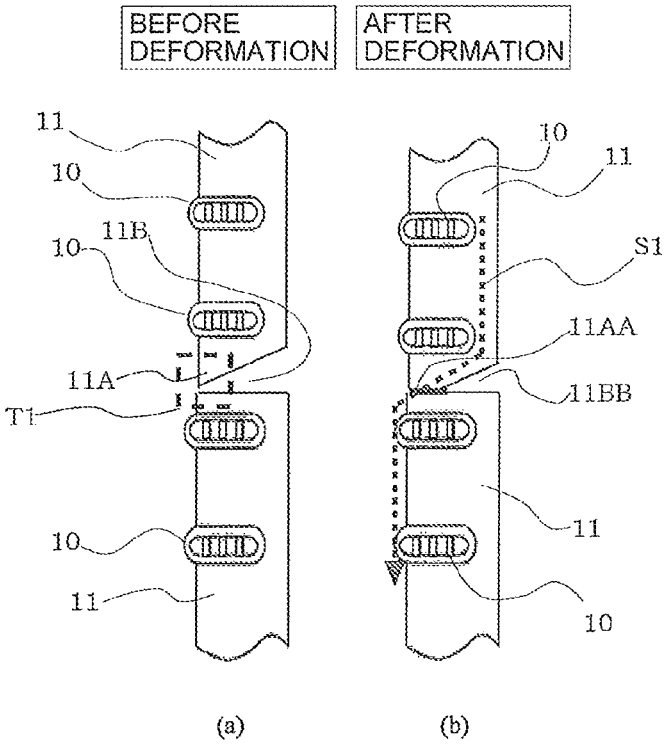
FIG. 8 are explanatory views of vertically-adjacent heat exchanger cores of an outdoor unit for an air-conditioning apparatus according to Embodiment 2 of the present invention.

FIG. 8 are explanatory views of vertically-adjacent heat exchanger cores 12 of an outdoor unit 1 for an air-conditioning apparatus according to Embodiment 2. In Embodiment 2, parts in common with those of Embodiment 1 are represented by the same reference symbols, and differences from Embodiment 1 are mainly described.

In Embodiment 1, the lower end side of the fin 11 of the heat exchanger core 12 of the upper-stage heat exchanger 6A and the lower end side of the fin 11 of the heat exchanger core 12 of the middle-stage heat exchanger 6B are parallel to the width direction of the fin 11. In Embodiment 2, the shape of the fin 11 is different from that of Embodiment 1.

In Embodiment 2, on the lower end side of the fin 11 of the heat exchanger core 12 of the upper-stage heat exchanger 6A, a deformable portion 11A is formed so that a part of the fin 11 on a side where the heat transfer tubes 10 are inserted is projected downward relative to a part of the fin 11 on a side where the heat transfer tubes 10 are not inserted. As illustrated in FIG. 8(*a*), the deformable portion 11A is formed into, for example, an acute triangle shape. Further, a clearance 11B is formed between the lower end side of the fin 11 of the heat exchanger core 12 of the upper-stage heat exchanger 6A and the upper end side of the fin 11 of the heat exchanger core 12 of the middle-stage heat exchanger 6B.

When the deformable portion 11A of the upper-stage heat exchanger 6A is deformed as illustrated in FIG. 8(*b*), a deformed portion 11AA is formed. Further, at a position between the lower end side of the fin 11 of the heat exchanger core 12 of the upper-stage heat exchanger 6A and the upper end side of the fin 11 of the heat exchanger core 12 of the middle-stage heat exchanger 6B, a clearance 11BB is formed so as to be expanded from one end side of the fin 11 in its width direction (side where the heat transfer tubes 10 are inserted) to the other end side of the fin 11 in its width direction (side where the heat transfer tubes 10 are not inserted). That is, when the heat exchanger 6 is dropped during, for example, transportation of the heat exchanger 6 so that impacts are applied to the lower end side of the fin 11 of the lower-stage heat exchanger 6C, a part of the deformable portion 11A of the upper-stage heat exchanger 6A on the one end side in the width direction of the fin 11 (see "T1" of FIG. 8(*a*)) is deformed as illustrated in FIG. 8(*b*) so that the deformed portion 11AA is formed to disperse the impacts generated on the lower end side of the fin 11 of the lower-stage heat exchanger 6C.

Further, the same applies to the middle-stage heat exchanger 6B and the lower-stage heat exchanger 6C. On the lower end side of the fin 11 of the heat exchanger core 12 of the middle-stage heat exchanger 6B, the deformable portion 11A is formed so that a part of the fin 11 on the side where the heat transfer tubes 10 are inserted is projected downward relative to a part of the fin 11 on the side where the heat transfer tubes 10 are not inserted. Further, the clearance 11B is formed between the lower end side of the fin 11 of the heat exchanger core 12 of the middle-stage heat exchanger 6B and the upper end side of the fin 11 of the heat exchanger core 12 of the lower-stage heat exchanger 6C.

When the deformable portion 11A of the middle-stage heat exchanger 6B is deformed as illustrated in FIG. 8(*b*), the deformed portion 11AA is formed. Further, at a position between the lower end side of the fin 11 of the heat exchanger core 12 of the middle-stage heat exchanger 6B and the upper end side of the fin 11 of the heat exchanger core 12 of the lower-stage heat exchanger 6C, the clearance 11BB is formed so as to be expanded from one end side of the fin 11 in its width direction (side where the heat transfer tubes 10 are inserted) to the other end side of the fin 11 in its width direction (side where the heat transfer tubes 10 are not inserted). That is, when the heat exchanger 6 is dropped during, for example, transportation of the heat exchanger 6 so that impacts are applied to the lower end side of the fin 11 of the lower-stage heat exchanger 6C, a part of the deformable portion 11A of the middle-stage heat exchanger 6B on the other end side in the width direction of the fin 11 (see "T1" of FIG. 8(*a*)) is deformed as illustrated in FIG. 8(*b*) so that the deformed portion 11AA is formed to disperse the impacts generated on the lower end side of the fin 11 of the lower-stage heat exchanger 6C.

A method of manufacturing the outdoor unit 1 for an air-conditioning apparatus according to Embodiment 2 is different from the method of manufacturing the outdoor unit 1 for an air-conditioning apparatus according to Embodiment 1 in the following point. A metal plate material is press-formed with a die having a preset shape to form cutouts to be used for inserting the heat transfer tubes 10, and also form the deformable portion 11A. The manufacturing method according to Embodiment 2 is similar to the manufacturing method according to Embodiment 1 in the other points.

[Effects of Outdoor Unit 1 for Air-Conditioning Device according to Embodiment 2]

In the outdoor unit 1 for an air-conditioning apparatus according to Embodiment 2, the following effects are attained in addition to the effects of the outdoor unit 1 for an air-conditioning apparatus according to Embodiment 1. The deformable portion 11A is formed on the lower end side of the fin 11 of each of the upper-stage heat exchanger 6A and the middle-stage heat exchanger 6B, and accordingly the fin 11 is deformed easily. As a result, the impacts generated on the lower end side of the fin 11 of the lower-stage heat exchanger 6C can be dispersed with higher efficiency.

For example, when a defrosting operation is carried out for the heat exchanger 6 of the outdoor unit 1, drain water is caused to flow as indicated by the arrow S1 of FIG. 8(*b*). That is, the drain water is caused to flow from a part of the fin 11 of the upper-stage heat exchanger 6A on the side where the heat transfer tubes 10 are not inserted through the deformed portion 11AA to a part of the fin 11 of the middle-stage heat exchanger 6B on the side where the heat transfer tubes 10 are inserted. Further, the drain water is caused to flow from a part of the fin 11 of the middle-stage heat exchanger 6B on the side where the heat transfer tubes 10 are not inserted through the deformed portion 11AA to a part of the fin 11 of the lower-stage heat exchanger 6C on the side where the heat transfer tubes 10 are inserted. When the drain water is caused to flow as described above, it is possible to suppress hindrance to the defrosting operation for frost adhering to a part of the lower heat exchanger (middle-stage heat exchanger 6B or lower-stage heat exchanger 6C) on an upstream side of air where the frost adhesion amount is larger, that is, on the side where the heat transfer tubes 10 are not inserted.

Figure 9:
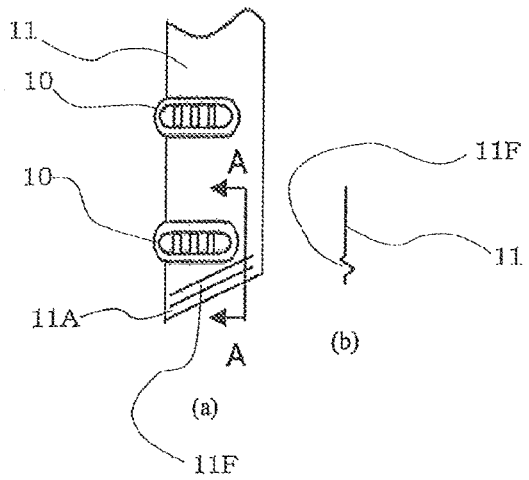
FIG. 9 are views of a modified example of the outdoor unit for an air-conditioning apparatus according to Embodiment 2 of the present invention.

FIG. 9 are views of a modified example of the outdoor unit 1 for an air-conditioning apparatus according to Embodiment 2. Note that, FIG. 9(*a*) is a view of the fin 11 of each of the upper-stage heat exchanger 6A and the middle-stage heat exchanger 6B when viewed in a direction perpendicular to a plane on the fin 11, and FIG. 9(*b*) is a sectional view taken along the line A-A of FIG. 9(*a*).

When the lower end side of the fin 11 of each of the upper-stage heat exchanger 6A and the middle-stage heat exchanger 6B is formed so as to easily guide water to a downstream side of air, the effect of suppressing hindrance to the defrosting operation for frost adhering to the fin 11 is further enhanced. As illustrated in FIG. 9(*a*) and FIG. 9(*b*), it is appropriate to form a groove portion 11F on the lower end side of the fin 11 so as to extend from the upstream side of air to the downstream side of air. As illustrated in FIG. 9(*a*), the groove portion 11F is formed in parallel to, for example, the lower end side of the fin 11.

Embodiment 3

Figure 10:
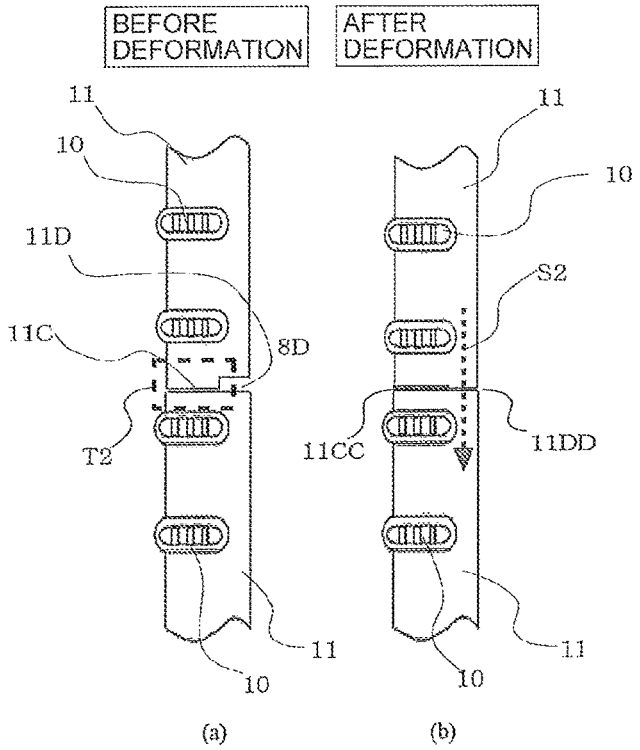
FIG. 10 are explanatory views of vertically-adjacent heat exchanger cores of an outdoor unit for an air-conditioning apparatus according to Embodiment 3 of the present invention.

FIG. 10 are explanatory views of vertically-adjacent heat exchanger cores 12 of an outdoor unit 1 for an air-conditioning apparatus according to Embodiment 3. In Embodiment 3, parts in common with those of Embodiments 1 and 2 are represented by the same reference symbols, and differences from Embodiments 1 and 2 are mainly described. In Embodiment 2, the deformable portion 11A is formed on the fin 11, but the shape of the deformable portion 11A is different in Embodiment 3.

In Embodiment 3, on the lower end side of the fin 11 of the heat exchanger core 12 of the upper-stage heat exchanger 6A, a deformable portion 11C is formed so that a part of the fin 11 on the side where the heat transfer tubes 10 are inserted is projected downward relative to a part of the fin 11 on the side where the heat transfer tubes 10 are not inserted. The deformable portion 11C has a rectangular shape unlike the deformable portion 11A of Embodiment 2. Note that, the width of the deformable portion 11C is set equal to or smaller than the length of the major axis of the heat transfer tube 10.

Further, a clearance 11D having a given distance in the width direction of the fin 11 is formed between the lower end side of the fin 11 of the heat exchanger core 12 of the upper-stage heat exchanger 6A and the upper end side of the fin 11 of the heat exchanger core 12 of the middle-stage heat exchanger 6B.

When the deformable portion 11C of the upper-stage heat exchanger 6A is deformed as illustrated in FIG. 10(*b*), a deformed portion 11CC is formed. Further, a part of the lower end side of the fin 11 of the heat exchanger core 12 of the upper-stage heat exchanger 6A where the deformable portion 11C is absent and the upper end side of the fin 11 of the heat exchanger core 12 of the middle-stage heat exchanger 6B are proximate to each other. The part where the upper and lower fins 11 are proximate to each other defines a proximate portion 11DD. Note that, the upper and lower fins 11 may be held in contact with each other or spaced away from each other at the proximate portion 11DD. When the upper and lower fins 11 are held in contact with each other at the proximate portion 11DD, the drain water can be drained to the lower side of the heat exchanger 6 with high efficiency.

When the heat exchanger 6 is dropped during, for example, transportation of the heat exchanger 6 so that impacts are applied to the lower end side of the fin 11 of the lower-stage heat exchanger 6C, a part of the deformable portion 11C of the upper-stage heat exchanger 6A on the other end side in the width direction of the fin 11 (see "T2" of FIG. 10(*a*)) is deformed as illustrated in FIG. 10(*b*) so that the deformed portion 11CC is formed to disperse the impacts generated on the lower end side of the fin 11 of the lower-stage heat exchanger 6C.

Further, the same applies to the middle-stage heat exchanger 6B and the lower-stage heat exchanger 6C. On the lower end side of the fin 11 of the heat exchanger core 12 of the middle-stage heat exchanger 6B, the deformable portion 11C is formed so that a part of the fin 11 on the side where the heat transfer tubes 10 are inserted is projected downward relative to a part of the fin 11 on the side where the heat transfer tubes 10 are not inserted.

Further, the clearance 11D is formed between the lower end side of the fin 11 of the heat exchanger core 12 of the middle-stage heat exchanger 6B and the upper end side of the fin 11 of the heat exchanger core 12 of the lower-stage heat exchanger 6C.

When the deformable portion 11C of the middle-stage heat exchanger 6B is deformed as illustrated in FIG. 10(*b*), the deformed portion 11CC is formed. Further, a part of the lower end side of the fin 11 of the heat exchanger core 12 of the middle-stage heat exchanger 6B where the deformable portion 11C is absent and the upper end side of the fin 11 of the heat exchanger core 12 of the lower-stage heat exchanger 6C are proximate to each other to define the proximate portion 11DD.

When the heat exchanger 6 is dropped during, for example, transportation of the heat exchanger 6 so that impacts are applied to the lower end side of the fin 11 of the lower-stage heat exchanger 6C, a part of the deformable portion 11C of the middle-stage heat exchanger 6B on the other end side in the width direction of the fin 11 (see "T2" of FIG. 10(*a*)) is deformed as illustrated in FIG. 10(*b*) so that the deformed portion 11CC is formed to disperse the impacts generated on the lower end side of the fin 11 of the lower-stage heat exchanger 6C.

A method of manufacturing the outdoor unit 1 for an air-conditioning apparatus according to Embodiment 3 is different from the method of manufacturing the outdoor unit 1 for an air-conditioning apparatus according to Embodiment 1 in the following point. A metal plate material is press-formed with a die having a preset shape to form cutouts to be used for inserting the heat transfer tubes 10, and also form the deformable portion 11C. The manufacturing method according to Embodiment 3 is similar to the manufacturing method according to Embodiment 1 in the other points.

[Effects of Outdoor Unit 1 for Air-Conditioning Device according to Embodiment 3]

In the outdoor unit 1 for an air-conditioning apparatus according to Embodiment 3, the following effects are attained in addition to the effects of the outdoor unit 1 for an air-conditioning apparatus according to Embodiment 1. The deformable portion 11C is formed on the lower end side of the fin 11 of each of the upper-stage heat exchanger 6A and the middle-stage heat exchanger 6B, and accordingly the fin 11 is deformed easily. As a result, the impacts generated on the lower end side of the fin 11 of the lower-stage heat exchanger 6C can be dispersed with higher efficiency.

For example, when the defrosting operation is carried out for the heat exchanger 6 of the outdoor unit 1, the drain water is caused to flow as indicated by the arrow S2 of FIG. 10(*b*). That is, the drain water is caused to flow from a part of the fin 11 of the upper-stage heat exchanger 6A on the side where the heat transfer tubes 10 are not inserted through the proximate portion 11DD to a part of the fin 11 of the middle-stage heat exchanger 6B on the side where the heat transfer tubes 10 are not inserted. Further, the drain water is caused to flow from a part of the fin 11 of the middle-stage heat exchanger 6B on the side where the heat transfer tubes 10 are not inserted through the proximate portion 11DD to a part of the fin 11 of the lower-stage heat exchanger 6C on the side where the heat transfer tubes 10 are not inserted. Thus, it is possible to suppress a situation where the drain water flowing from the upper-stage heat exchanger 6A to the middle-stage heat exchanger 6B stagnates between the upper-stage heat exchanger 6A and the middle-stage heat exchanger 6B and a situation where the drain water flowing from the middle-stage heat exchanger 6B to the lower-stage heat exchanger 6C stagnates between the middle-stage heat exchanger 6B and the lower-stage heat exchanger 6C. As a result, the drainage can be enhanced.

In the outdoor unit 1 for an air-conditioning apparatus according to Embodiment 3, the width of the deformable portion 11C is set equal to or smaller than the length of the major axis of the heat transfer tube 10, thereby being capable of suppressing, with high efficiency, the situation where the drain water flowing from the upper-stage heat exchanger 6A to the middle-stage heat exchanger 6B stagnates between the upper-stage heat exchanger 6A and the middle-stage heat exchanger 6B and the situation where the drain water flowing from the middle-stage heat exchanger 6B to the lower-stage heat exchanger 6C stagnates between the middle-stage heat exchanger 6B and the lower-stage heat exchanger 6C.

Embodiment 4

Figure 11:
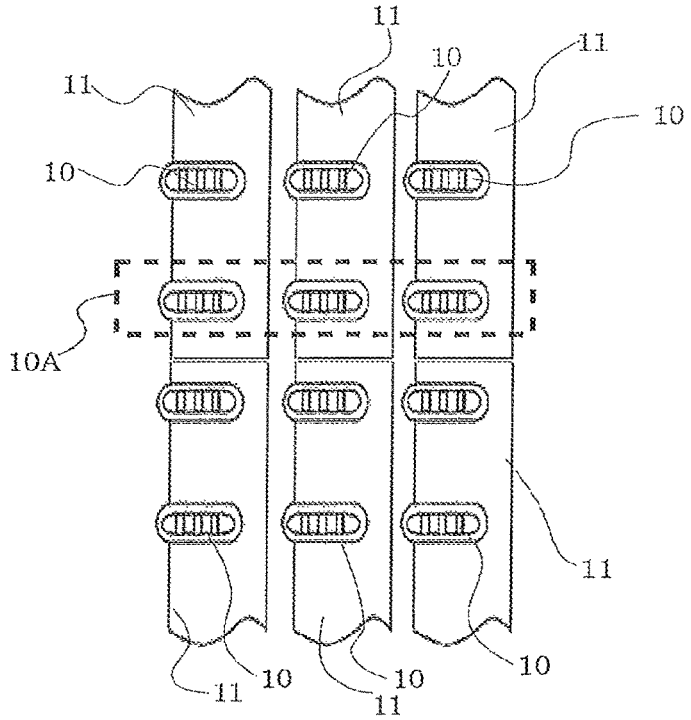
FIG. 11 is an explanatory view of vertically-adjacent heat exchanger cores of an outdoor unit for an air-conditioning apparatus according to Embodiment 4 of the present invention.

FIG. 11 is an explanatory view of vertically-adjacent heat exchanger cores 12 of an outdoor unit 1 for an air-conditioning apparatus according to Embodiment 4. In Embodiment 4, parts in common with those of Embodiments 1 to 3 are represented by the same reference symbols, and differences from Embodiments 1 to 3 are mainly described. In Embodiment 4, there are set heat transfer tubes 10 to be supplied with a hot gas preferentially during the defrosting operation so as to prevent development of freezing of drain water stagnating at a separation part between the upper-stage heat exchanger 6A and the middle-stage heat exchanger 6B, and at a separation part between the middle-stage heat exchanger 6B and the lower-stage heat exchanger 6C.

The heat exchanger cores 12 of the upper-stage heat exchanger 6A are configured such that the hot gas is supplied to heat transfer tubes 10A inserted into the lower end side of the fins 11 ahead of the heat transfer tubes 10 other than the heat transfer tubes 10A. Further, the heat exchanger cores 12 of the middle-stage heat exchanger 6B are configured such that the hot gas is supplied to the heat transfer tubes 10A inserted into the lower end side of the fins 11 ahead of the heat transfer tubes 10 other than the heat transfer tubes 10A.

That is, the compressor 24 and the heat exchanger 6 are configured such that, when the hot gas is supplied to the upper-stage heat exchanger 6A, the hot gas is first supplied to the heat transfer tubes 10A of the upper-stage heat exchanger 6A and the heat transfer tubes 10A of the middle-stage heat exchanger 6B.

Note that, when the hot gas is particularly preferentially supplied to one of the heat transfer tubes 10A on the upstream side of air where frost is most liable to adhere, the defrosting effect during the defrosting operation can be enhanced. Further, FIG. 11 illustrates as an example the case where three rows of the heat exchanger cores 12 are stacked, but the present invention is not limited thereto. Similar effects may also be attained in a case of one row of the heat exchanger core 12 or a plurality of rows of the heat exchanger cores 12 other than the three rows.

[Effects of Outdoor Unit 1 for Air-Conditioning Device according to Embodiment 4]

In the outdoor unit 1 for an air-conditioning apparatus according to Embodiment 4, the following effects are attained in addition to the effects of the outdoor unit 1 for an air-conditioning apparatus according to Embodiment 1.

In the outdoor unit 1 for an air-conditioning apparatus according to Embodiment 4, the hot gas is preferentially supplied to the heat transfer tubes 10A during the defrosting operation, thereby being capable of suppressing, with high efficiency, the development of freezing of drain water stagnating at the separation part between the upper-stage heat exchanger 6A and the middle-stage heat exchanger 6B, and at the separation part between the middle-stage heat exchanger 6B and the lower-stage heat exchanger 6C.

Note that, Embodiment 4 may be combined as appropriate with Embodiment 2 or 3, or with Embodiment 5 described later. That is, the shape of the fin 11 of the outdoor unit 1 for an air-conditioning apparatus according to Embodiment 4 may be changed to the shape of the fin 11 of the outdoor unit 1 for an air-conditioning apparatus according to Embodiment 2, 3, or 5. Also in this case, similar effects to those of Embodiment 4 may be attained.

Embodiment 5

Figure 12:
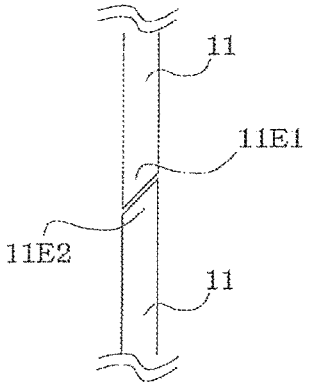
FIG. 12 is an explanatory view of vertically-adjacent heat exchanger cores of an outdoor unit for an air-conditioning apparatus according to Embodiment 5 of the present invention.

FIG. 12 is an explanatory view of vertically-adjacent heat exchanger cores 12 of an outdoor unit 1 for an air-conditioning apparatus according to Embodiment 5. In Embodiment 5, parts in common with those of Embodiments 1 to 4 are represented by the same reference symbols, and differences from Embodiments 1 to 4 are mainly described. In Embodiments 2 and 3, the deformable portions 11A and 11C are formed on the upper one of the heat exchanger cores 12, respectively, but in Embodiment 4, a deformable portion 11E1 and a deformable portion 11E2 are formed on both of the vertically-adjacent heat exchanger cores 12.

On the lower end side of the fin 11 of the heat exchanger core 12 of the upper-stage heat exchanger 6A, the deformable portion 11E1 is formed so that a part of the fin 11 on one side in its thickness direction is projected downward relative to a part of the fin 11 on the other side in its thickness direction. Further, on the upper end side of the fin 11 of the heat exchanger core 12 of the middle-stage heat exchanger 6B, the deformable portion 11E2 is formed so that a part of the fin 11 on the other side in its thickness direction is projected upward relative to a part of the fin 11 on one side in its thickness direction.

Further, on the lower end side of the fin 11 of the heat exchanger core 12 of the middle-stage heat exchanger 6B, the deformable portion 11E1 is formed so that a part of the fin 11 on one side in its thickness direction is projected downward relative to a part of the fin 11 on the other side in its thickness direction. Further, on the upper end side of the fin 11 of the heat exchanger core 12 of the lower-stage heat exchanger 6C, the deformable portion 11E2 is formed so that a part of the fin 11 on the other side in its thickness direction is projected upward relative to a part of the fin 11 on one side in its thickness direction.

[Effects of Outdoor Unit 1 for Air-Conditioning Device according to Embodiment 5]

In the outdoor unit 1 for an air-conditioning apparatus according to Embodiment 5, similar effects to those of the outdoor unit 1 for an air-conditioning apparatus according to Embodiment 1 are attained.

The invention claimed is:

1. An outdoor unit for an air-conditioning apparatus, the outdoor unit comprising a heat exchanger having heat exchanger cores stacked in a vertical direction of the outdoor unit, each of the heat exchanger cores including a plurality of fins arranged in parallel to each other at intervals therebetween; and heat transfer tubes provided to extend through the plurality of fins, each of the heat transfer tubes allowing refrigerant to flow therethrough, the heat exchanger including an upper one of the heat exchanger cores and a lower one of the heat exchanger cores, the upper one of the heat exchanger cores and the lower one of the heat exchanger cores being adjacent to each other in the vertical direction of the outdoor unit, each of the plurality of fins of the heat exchanger including a deformable portion configured to be deformable by impacts applied to the deformable portion, the deformable portion being formed at a position where the plurality of fins of the upper one of the heat exchanger cores come into contact with the plurality of fins of the lower one of the heat exchanger cores, each of the plurality of fins of the upper one of the heat exchanger cores including a lower end side and each of the plurality of fins of the lower one of the heat exchanger cores including an upper end side, and the lower end side of the plurality of fins of the upper one of the heat exchanger cores and the upper end side of the plurality of fins of the lower one of the heat exchanger cores being parallel to each other in a width direction of the plurality of fins viewed in the vertical direction, wherein the deformable portion is formed in a downwardly projecting manner on the lower end side, at a first wall side in the width direction, of each of the plurality of fins of the upper one of the heat exchanger cores, and wherein a clearance is formed at a part of the lower end side of each of the plurality of fins of the upper one of the heat exchanger cores where the deformable portion is absent, the clearance being formed so that a vertical distance between the lower end side of each of the plurality of fins of the upper one of the heat exchanger cores and the upper end side of each of the plurality of fins of the lower one of the heat exchanger cores increases toward a second wall side away in the width direction from the first wall side of each of the plurality of fins of the upper one of the heat exchanger cores.

2. The outdoor unit for an air-conditioning apparatus of claim 1, further comprising a compressor for supplying a hot gas to the heat exchanger during a defrosting operation, wherein the heat exchanger is configured such that the hot gas from the compressor is supplied to heat transfer tubes inserted into the lower end side of the plurality of fins of the upper one of the heat exchanger cores before being supplied to any other heat transfer tubes of the plurality of fins of the upper one of the heat exchanger cores.

3. The outdoor unit for an air-conditioning apparatus of claim 1, wherein each of the heat transfer tubes includes a flat tube inserted into each of the plurality of fins so that a major axis of the flat tube is parallel to the width direction of each of the plurality of fins.

4. The outdoor unit for an air-conditioning apparatus of claim 1, wherein the heat transfer tubes of each of the heat exchanger cores are inserted into one end side of each of the plurality of fins of respective heat exchanger cores in the width direction of each of the plurality of fins.

5. The outdoor unit for an air-conditioning apparatus of claim 1, wherein a number of the heat exchanger cores stacked in the vertical direction is set based on buckling strength of each of the plurality of fins and a total weight of the plurality of fins and the heat transfer tubes.

6. The outdoor unit for an air-conditioning apparatus of claim 1, wherein each of the heat transfer tubes is made of aluminum.

7. The outdoor unit for an air-conditioning apparatus of claim 1, wherein the heat exchanger includes at least one bending portion where the heat exchanger is bent in horizontal cross section.

8. An outdoor unit for an air-conditioning apparatus, the outdoor unit comprising a heat exchanger having heat exchanger cores stacked in a vertical direction of the outdoor unit, each of the heat exchanger cores including a plurality of fins arranged in parallel to each other at intervals therebetween; and heat transfer tubes provided to extend through the plurality of fins, each of the heat transfer tubes allowing refrigerant to flow therethrough, the heat exchanger including an upper one of the heat exchanger cores and a lower one of the heat exchanger cores, the upper one of the heat exchanger cores and the lower one of the heat exchanger cores being adjacent to each other in the vertical direction of the outdoor unit, each of the plurality of fins of the heat exchanger including a deformable portion configured to be deformable by impacts applied to the deformable portion, the deformable portion being formed at a position where the plurality of fins of the upper one of the heat exchanger cores come into contact with the plurality of fins of the lower one of the heat exchanger cores, each of the plurality of fins of the upper one of the heat exchanger cores including a lower end side and each of the plurality of fins of the lower one of the heat exchanger cores including an upper end side, and the lower end side of the plurality of fins of the upper one of the heat exchanger cores and the upper end side of the plurality of fins of the lower one of the heat exchanger cores being parallel to each other in a width direction of the plurality of fins viewed in the vertical direction, wherein the deformable portion is formed in a downwardly projecting manner on the lower end side, at a first wall side in the width direction, of each of the plurality of fins of the upper one of the heat exchanger cores, and wherein a clearance is formed with a constant distance in the vertical direction to the upper end side of each of the plurality of fins of the lower one of the heat exchanger cores at a part of the lower end side of each of the plurality of fins of the upper one of the heat exchanger cores where the deformable portion is absent.

9. The outdoor unit for an air-conditioning apparatus of claim 8, further comprising a compressor for supplying a hot gas to the heat exchanger during a defrosting operation, wherein the heat exchanger is configured such that the hot gas from the compressor is supplied to heat transfer tubes inserted into the lower end side of the plurality of fins of the upper one of the heat exchanger cores before being supplied to any other heat transfer tubes of the plurality of fins of the upper one of the heat exchanger cores.

10. The outdoor unit for an air-conditioning apparatus of claim 8, wherein each of the heat transfer tubes includes a flat tube inserted into each of the plurality of fins so that a major axis of the flat tube is parallel to the width direction of each of the plurality of fins.

11. The outdoor unit for an air-conditioning apparatus of claim 8, wherein the heat transfer tubes of each of the heat exchanger cores are inserted into one end side of each of the plurality of fins of respective heat exchanger cores in the width direction of each of the plurality of fins.

12. The outdoor unit for an air-conditioning apparatus of claim 8, wherein a number of the heat exchanger cores stacked in the vertical direction is set based on buckling strength of each of the plurality of fins and a total weight of the plurality of fins and the heat transfer tubes.

13. An outdoor unit for an air-conditioning apparatus, the outdoor unit comprising a heat exchanger having heat exchanger cores stacked in a vertical direction of the outdoor unit, each of the heat exchanger cores including a plurality of fins arranged in parallel to each other at intervals therebetween; and heat transfer tubes provided to extend through the plurality of fins, each of the heat transfer tubes allowing refrigerant to flow therethroug the heat exchanger including an upper one of the heat exchanger cores and a lower one of the heat exchanger cores, the upper one of the heat exchanger cores and the lower one of the heat exchanger cores being adjacent to each other in the vertical direction of the outdoor unit, each of the plurality of fins of the heat exchanger including a deformable portion configured to be deformable by impacts applied to the deformable portion, the deformable portion being formed at a position where the plurality of fins of the upper one of the heat exchanger cores come into contact with the plurality of fins of the lower one of the heat exchanger cores, each of the plurality of fins of the upper one of the heat exchanger cores including a lower end side and each of the plurality of fins of the lower one of the heat exchanger cores including an upper end side, and the lower end side of the plurality of fins of the upper one of the heat exchanger cores and the upper end side of the plurality of fins of the lower one of the heat exchanger cores being parallel to each other in a width direction of the plurality of fins viewed in the vertical direction, wherein the outdoor unit for an air-conditioning apparatus further comprises a compressor for supplying a hot gas to the heat exchanger during a defrosting operation, and wherein the heat exchanger is configured such that the hot gas from the compressor is supplied to heat transfer tubes inserted into the lower end side of the plurality of fins of the upper one of the heat exchanger cores before being supplied to any other heat transfer tubes of the plurality of fins of the upper one of the heat exchanger cores.

14. The outdoor unit for an air-conditioning apparatus of claim 13, wherein the deformable portion is formed in a downwardly projecting manner on the lower end side, at a first wall side in the width direction, of each of the plurality of fins of the upper one of the heat exchanger cores.

15. The outdoor unit for an air-conditioning apparatus of claim 14, wherein a clearance is formed at a part of the lower end side of each of the plurality of fins of the upper one of the heat exchanger cores where the deformable portion is absent, the clearance being formed so that a vertical distance between the lower end side of each of the plurality of fins of the upper one of the heat exchanger cores and the upper end side of each of the plurality of fins of the lower one of the heat exchanger cores increases toward a second wall side away in the width direction from the first wall side of each of the plurality of fins of the upper one of the heat exchanger cores.

16. The outdoor unit for an air-conditioning apparatus of claim 14, wherein a clearance is formed with a constant distance in the vertical direction to the upper end side of each of the plurality of fins of the lower one of the heat exchanger cores at a part of the lower end side of each of the plurality of fins of the upper one of the heat exchanger cores where the deformable portion is absent.

17. The outdoor unit for an air-conditioning apparatus of claim 13, wherein:

the deformable portion is formed on the lower end side of each of the plurality of fins of the upper one of the heat exchanger cores, the deformable portion being formed so that a part of each of the plurality of fins of the upper one of the heat exchanger cores on a first wall side in the thickness direction is projected downward relative to a part of each of the plurality of fins of the upper one of the heat exchanger cores on a second wall side, and the deformable portion is further formed on the upper end side of each of the plurality of fins of the lower one of the heat exchanger cores, the deformable portion further being formed so that a part of each of the plurality of fins of the lower one of the heat exchanger cores on the second wall side is projected upward relative to a part of each of the plurality of fins of the lower one of the heat exchanger cores on the first wall side.

18. The outdoor unit for an air-conditioning apparatus of claim 13, wherein each of the heat transfer tubes includes a flat tube inserted into each of the plurality of fins so that a major axis of the flat tube is parallel to the width direction of each of the plurality of fins.

19. The outdoor unit for an air-conditioning apparatus of claim 13, wherein the heat transfer tubes of each of the heat exchanger cores are inserted into one end side of each of the plurality of fins of respective heat exchanger cores in the width direction of each of the plurality of fins.

20. The outdoor unit for an air-conditioning apparatus of claim 13, wherein a number of the heat exchanger cores stacked in the vertical direction is set based on buckling strength of each of the plurality of fins and a total weight of the plurality of fins and the heat transfer tubes.

* * * * *